US011357318B2

(12) United States Patent
Taylor

(10) Patent No.: US 11,357,318 B2
(45) Date of Patent: Jun. 14, 2022

(54) FOLDING WORK SURFACE

(71) Applicant: Process4, Inc., Chagrin Falls, OH (US)

(72) Inventor: Curtis Taylor, Chagrin Falls, OH (US)

(73) Assignee: PROCESS4, INC., Chagrin Falls, OH (US)

( * ) Notice: Subject to any disclaimer, the term of this patent is extended or adjusted under 35 U.S.C. 154(b) by 0 days.

(21) Appl. No.: 17/021,397

(22) Filed: Sep. 15, 2020

(65) Prior Publication Data

US 2021/0076815 A1 Mar. 18, 2021

Related U.S. Application Data

(60) Provisional application No. 62/900,801, filed on Sep. 16, 2019.

(51) Int. Cl.

| | |
|---|---|
| ***A47B 3/12*** | (2006.01) |
| ***A47B 3/00*** | (2006.01) |
| ***A47B 3/06*** | (2006.01) |

(52) U.S. Cl.

CPC ..... *A47B 3/12* (2013.01); *A47B 3/002* (2013.01); *A47B 3/06* (2013.01); *A47B 2003/008* (2013.01)

(58) Field of Classification Search

CPC .. A47B 3/12; A47B 3/002; A47B 3/06; A47B 2003/008

See application file for complete search history.

(56) References Cited

U.S. PATENT DOCUMENTS

| | | | | | |
|---|---|---|---|---|---|
| 2,639,114 | A * | 5/1953 | Allen | A63F 7/025 | 248/167 |
| 3,808,305 | A * | 4/1974 | Gregor | B01D 69/02 | 264/331.12 |
| 4,630,861 | A * | 12/1986 | Henschel | A47C 4/08 | 108/124 |
| 5,562,050 | A * | 10/1996 | Colquhoun | A47B 3/002 | 108/115 |
| 5,664,854 | A * | 9/1997 | Letch | A47B 43/00 | 312/114 |
| 6,286,824 | B1 * | 9/2001 | Sagol | B25H 1/04 | 269/900 |
| 6,779,466 | B2 * | 8/2004 | Shabram, Jr. | A47B 3/0912 | 108/115 |
| 8,740,318 | B2 * | 6/2014 | DeMars | E04H 1/1222 | 312/140.2 |
| 10,271,655 | B1 * | 4/2019 | Gwen | A47C 4/10 | |
| 2008/0078309 | A1 * | 4/2008 | Eveleth | A47B 3/10 | 108/115 |
| 2009/0301361 | A1 * | 12/2009 | Hsieh | A47C 4/02 | 108/129 |
| 2015/0305491 | A1 * | 10/2015 | Orsini | A47B 3/06 | 108/116 |
| 2019/0159590 | A1 * | 5/2019 | Lin | A47B 47/0075 | |

* cited by examiner

*Primary Examiner* — Daniel J Rohrhoff
(74) *Attorney, Agent, or Firm* — Ulmer & Berne, LLP; Brian E Turung

(57) ABSTRACT

A folding table or work surface configurable between an assembled configuration and a bundled configuration. The folding table generally includes a body with one or more collapsible sidewalls, one or more shelves, and a lid.

17 Claims, 10 Drawing Sheets

FOLDING WORK SURFACE

The present disclosure claims priority on U.S. Provisional Application Ser. No. 62/900,801 filed Aug. 16, 2019, which is incorporated herein by reference.

The present disclosure sets forth a folding table or work surface which is configurable between an assembled configuration and a bundled configuration. However, it is to be appreciated that the present disclosure is also amenable to other like applications.

BACKGROUND

Tables and other types of flat-top surfaces are typically utilized to provide a level surface on which objects may be placed for various purposes. However, level work surfaces are not always available at locations which would benefit from having the same. For example, various job and constructions sites often require tables to facilitate the work being done at those sites. It is common for existing tables which meet this need to be rigid, inflexible monolithic structures which are somewhat expensive and difficult to transport, store, and dispose of after use.

It would be desirable to provide an inexpensive structure which provides a level work surface that is easy to transport, store, and dispose of after it is no longer needed.

BRIEF DESCRIPTION

In accordance with one non-limiting aspect of the present disclosure, a folding table or work surface is described which is configurable between an assembled configuration and a bundled configuration. The exemplary folding table generally includes a main body portion with one or more collapsible sidewalls, one or more shelves, and a lid which provides the primary level working surface of the table.

In accordance with another and/or alternative non-limiting aspect of the present disclosure, the primary components of the folding table include a main body portion which supports an upper shelf, a lower shelf, and a lid which provides the primary work surface of the folding table.

In accordance with another and/or alternative non-limiting aspect of the present disclosure, the folding table can optionally be provided in a bundled configuration. Such configuration can be used to reduce the space of the folding tabled during the sale of the table at a store, and during the transport of the folding table to a certain location. Such bundled configuration also facilitates in the ease of transport of the folding table.

In accordance with another and/or alternative non-limiting aspect of the present disclosure, the bundled configuration of the folding table can optionally be maintained by securement features.

In accordance with another and/or alternative non-limiting aspect of the present disclosure, the main body portion of the folding table includes a front wall, an opposing back wall, and one or more collapsible sidewalls, all of which generally extend between a top portion and a lower portion of the body. An open interior region is defined by the front wall, back wall, and sidewalls.

In accordance with another and/or alternative non-limiting aspect of the present disclosure, the main body portion optionally includes one or more cut-outs located generally adjacent the body's lower portion and defines table legs on the front wall, back wall, and/or sidewalls of the folding table.

In accordance with another and/or alternative non-limiting aspect of the present disclosure, the front wall and/or back wall of the main body portion can optionally include a respective opening that is sized to receive and support end portions of the lower shelf.

In accordance with another and/or alternative non-limiting aspect of the present disclosure, the main body portion can optionally include collapsible sidewalls. Such optional collapsible sidewalls can optionally include one or more fold lines, serrations, and/or grooves to facilitate in the folding of the sidewall. The fold lines (when used) are generally made by forming a reduced thickness or reduced stiffness portion along each fold line and on at least one side thereof.

In accordance with another and/or alternative non-limiting aspect of the present disclosure, the main body portion can optionally include one or more securement features. The one or more securement features (when used) can be disposed on the exterior surface and/or interior surface of the sidewalls. The one or more securement features (when used) can be configured to engage with corresponding securement features disposed on the lid when the folding table is in the assembled configuration. The one or more securement features can also or alternatively be configured to engage with corresponding securement features disposed on the upper shelf when the folding table is in the assembled configuration.

In accordance with another and/or alternative non-limiting aspect of the present disclosure, the lower shelf component can optionally be comprised of one or more segments which are generally configured to allow folding of the lower shelf from a substantially flat arrangement to a non-flat arrangement (e.g., U-shaped arrangement, etc.). The folding of segments (when used) can be provided by one or more fold lines which, similar to fold lines.

In accordance with another and/or alternative non-limiting aspect of the present disclosure, one or more notches are optionally formed in the lower shelf to allow the lower shelf to securely fit within respective openings on the front and back walls of the body.

In accordance with another and/or alternative non-limiting aspect of the present disclosure, the top surface of the upper shelf optionally provides another surface for storing items in the folding table.

In accordance with another and/or alternative non-limiting aspect of the present disclosure, the lid of the folding table includes a top surface that functions as the primary work surface provided by the folding table. The top surface can optionally include a protective layer that can be used to provide structural strength to the lip, provide scratch and/or puncture resistance to the lip, and/or form a water-repellant or water-resistant surface on the lid.

In accordance with another and/or alternative non-limiting aspect of the present disclosure, the interior region of the lid optionally has a depth such that the remaining components of the folding table (including body, upper shelf, and lower shelf) fit substantially within the interior region when in their bundled configuration.

In accordance with another and/or alternative non-limiting aspect of the present disclosure, one or more securement features are configured to maintain the bundled configuration of the folding table.

In accordance with another and/or alternative non-limiting aspect of the present disclosure, the foldable table comprises a main body portion, an upper shelf, a lower shelf, and a lid, said main body portion including foldable side walls to enable said main body to be configured between a collapsed position and non-collapsed position, said lower shelf releasably supported on said main body portion when said foldable table is fully assembled and said main body is in said non-collapsed position, said upper shelf removably positioned above said lower shelf when said foldable table is fully assembled and said main body is in said non-collapsed position, said lid positioned on said upper edges of said main body portion when said foldable table is fully assembled, said lid providing a primary work surface of said folding table when said foldable table is fully assembled.

In accordance with another and/or alternative non-limiting aspect of the present disclosure, the foldable table includes a main body portion including a body securement feature and said lid including a lid securement feature, said body securement feature and said lid securement feature configured to releasably connect together to releasably secure said lid to said main body portion when said foldable table is fully assembled and said main body portion is in said non-collapsed position.

In accordance with another and/or alternative non-limiting aspect of the present disclosure, the foldable table includes a lid including a lid securement feature and said upper shelf including a shelf securement feature, said lid securement feature and said shelf securement feature configured to releasably connect together to releasably secure said lid to said upper shelf when said main body portion, said upper shelf, and said lower shelf positioned in the underside cavity of said lid and said main body portion is in said collapsed position.

In accordance with another and/or alternative non-limiting aspect of the present disclosure, the foldable table includes a main body portion including a front wall, an opposing back wall, two collapsible sidewalls, and an open interior region defined by said front wall, said back wall, and said two sidewalls.

In accordance with another and/or alternative non-limiting aspect of the present disclosure, the foldable table includes a bottom portion of said main body portion including a cut-out portion forming one or more table legs on one or more of said front wall, said back wall, and said two sidewalls.

In accordance with another and/or alternative non-limiting aspect of the present disclosure, the foldable table wherein each of said sidewalls on said main body includes one or more fold lines, serrations, and/or grooves to facilitate in folding said sidewalls.

In accordance with another and/or alternative non-limiting aspect of the present disclosure, the foldable table wherein the lower shelf includes a plurality of segments configured such that adjacently positioned segments are foldable with respect to one another.

In accordance with another and/or alternative non-limiting aspect of the present disclosure, the foldable table wherein the lower shelf includes notches configured to enable said lower shelf to fit within openings in said front and back walls of said main body portion.

In accordance with another and/or alternative non-limiting aspect of the present disclosure, the foldable table wherein the lid includes a top surface having a protective layer, said protective layer having a thickness of 0.001-0.25 inches.

These and other objects and advantages will become apparent from the discussion of the distinction between the present disclosure and the prior art and when considering the non-limiting embodiments of the disclosure as shown in the accompanying drawings.

BRIEF DESCRIPTION OF THE DRAWINGS

Reference may now be made to the drawings, which illustrate various embodiments that the disclosure may take in physical form and in certain parts and arrangement of parts wherein.

DETAILED DESCRIPTION

Figure 1:
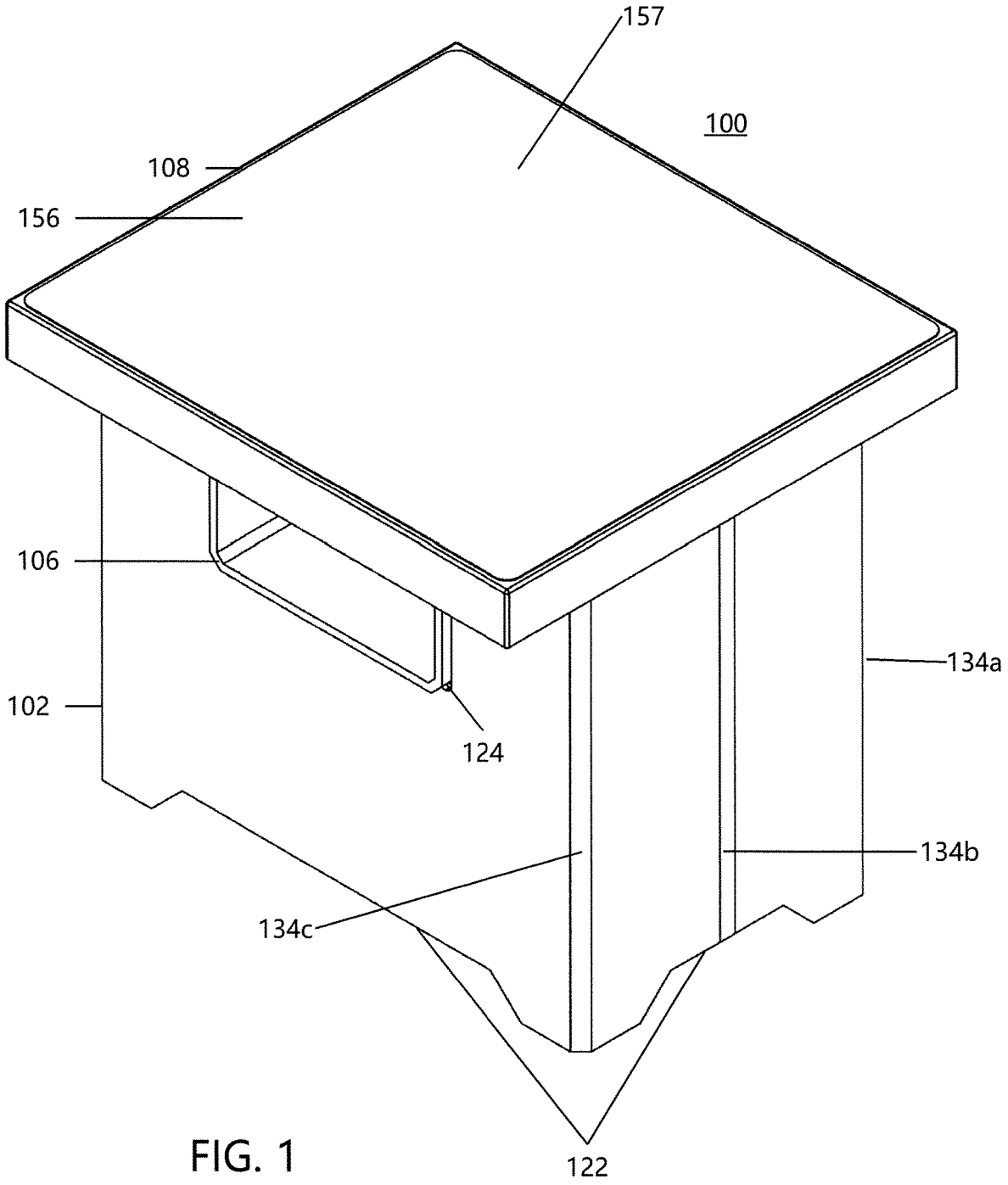
FIG. 1 is an illustration according to one non-limiting embodiment of the present disclosure which illustrates a perspective view of a folding table or work surface in an assembled configuration.
Figure 2:
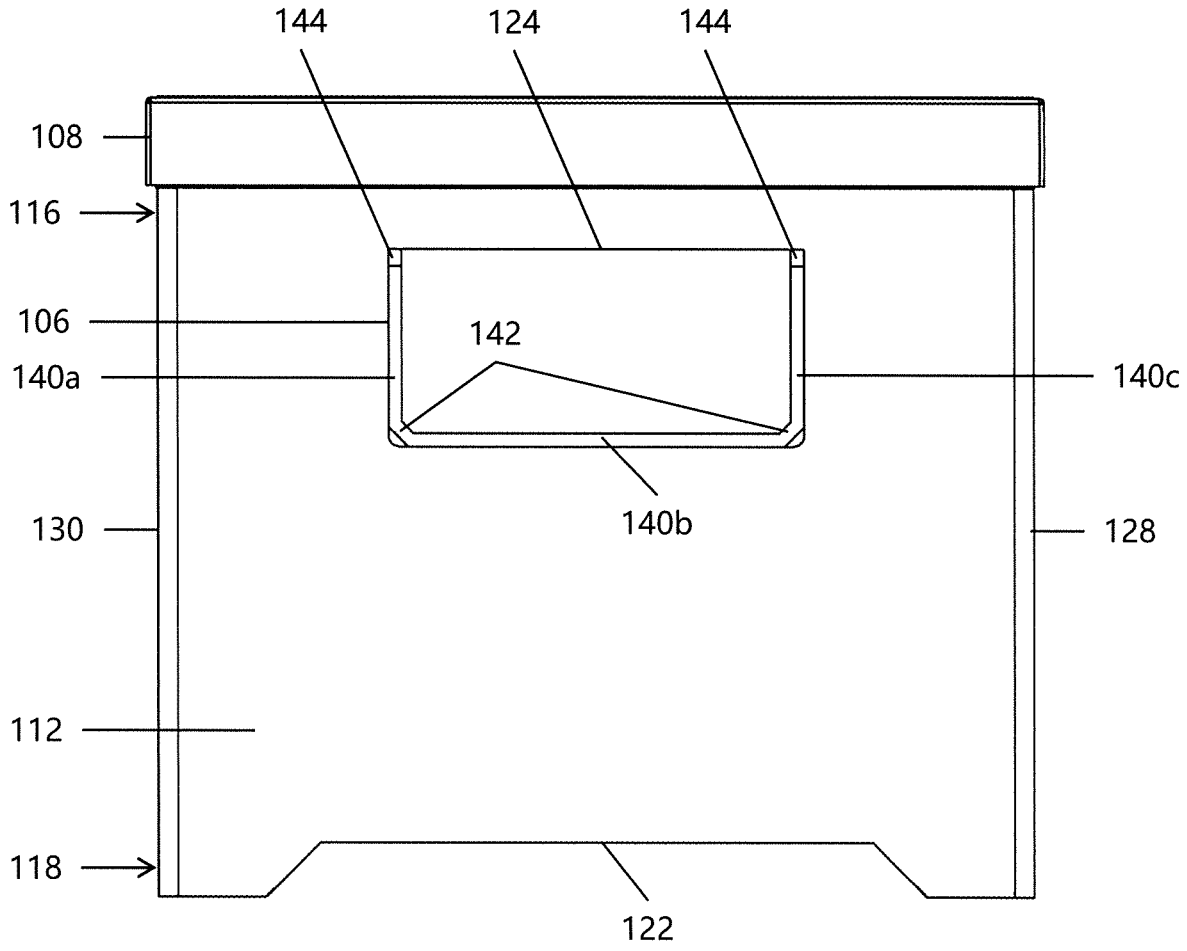
FIG. 2 is a front elevation view of the folding table of FIG. 1.

A more complete understanding of the articles/devices, processes, and components disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the term "comprising" may include the embodiments "consisting of" and "consisting essentially of." The terms "comprise(s)," "include(s)," "having," "has," "can," "contain(s)," and variants thereof, as used herein, are intended to be open-ended transitional phrases, terms, or words that require the presence of the named ingredients/steps and permit the presence of other ingredients/steps. However, such description should be construed as also describing compositions or processes as "consisting of" and "consisting essentially of" the enumerated ingredients/steps, which allows the presence of only the named ingredients/steps, along with any unavoidable impurities that might result therefrom, and excludes other ingredients/steps.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values).

The terms "about" and "approximately" can be used to include any numerical value that can vary without changing the basic function of that value. When used with a range, "about" and "approximately" also disclose the range defined by the absolute values of the two endpoints, e.g. "about 2 to about 4" also discloses the range "from 2 to 4." Generally, the terms "about" and "approximately" may refer to plus or minus 10% of the indicated number.

Referring now to the drawings, wherein the showings are for the purpose of illustrating non-limiting embodiments of the disclosure only and not for the purpose of limiting the same, FIGS. 1-11 illustrate various aspects of a folding table or work surface 100 which is configurable between an assembled configuration and a bundled configuration.

Figure 3:
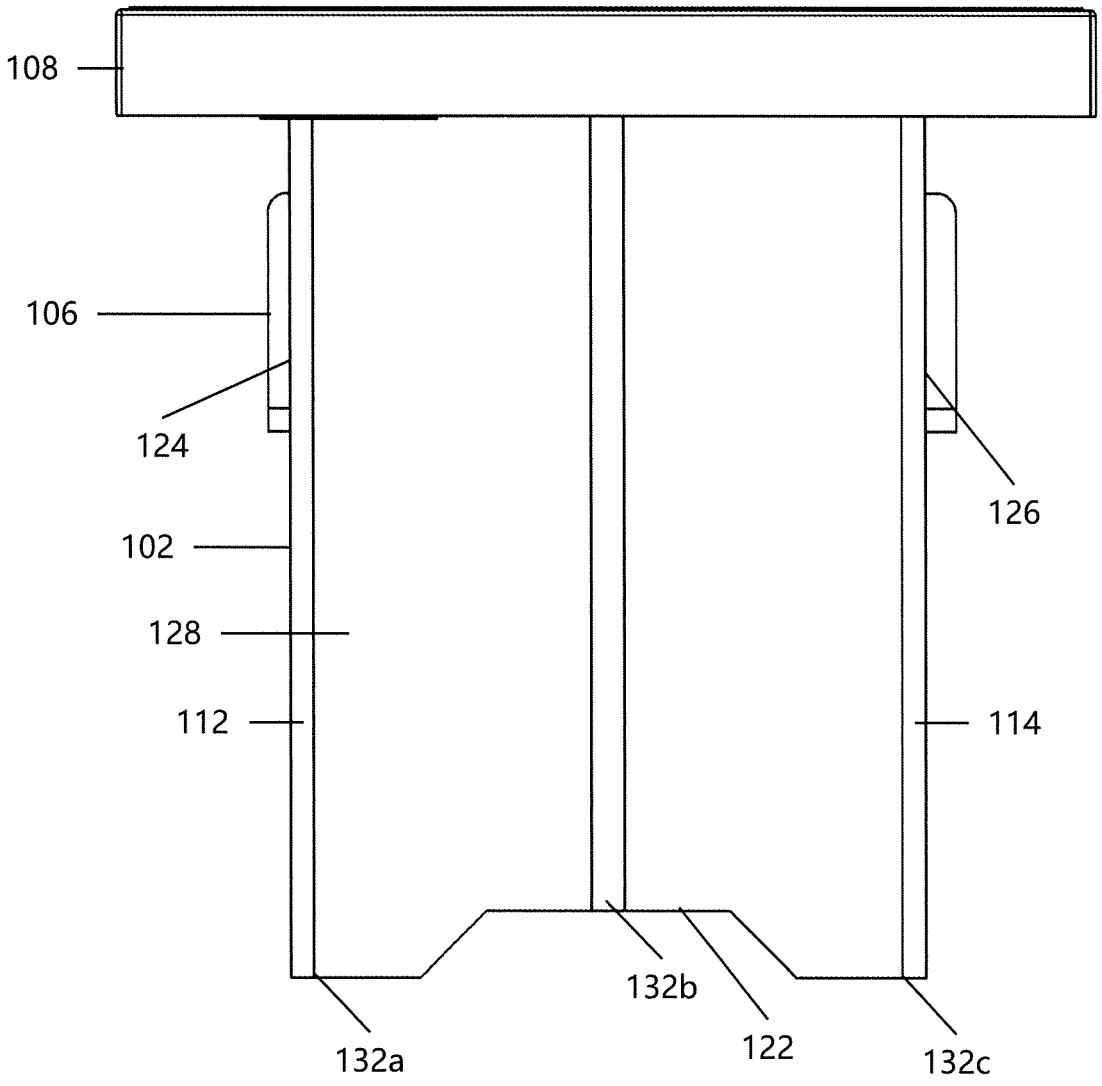
FIG. 3 is a side elevation view of the folding table of FIG. 1.
Figure 4:
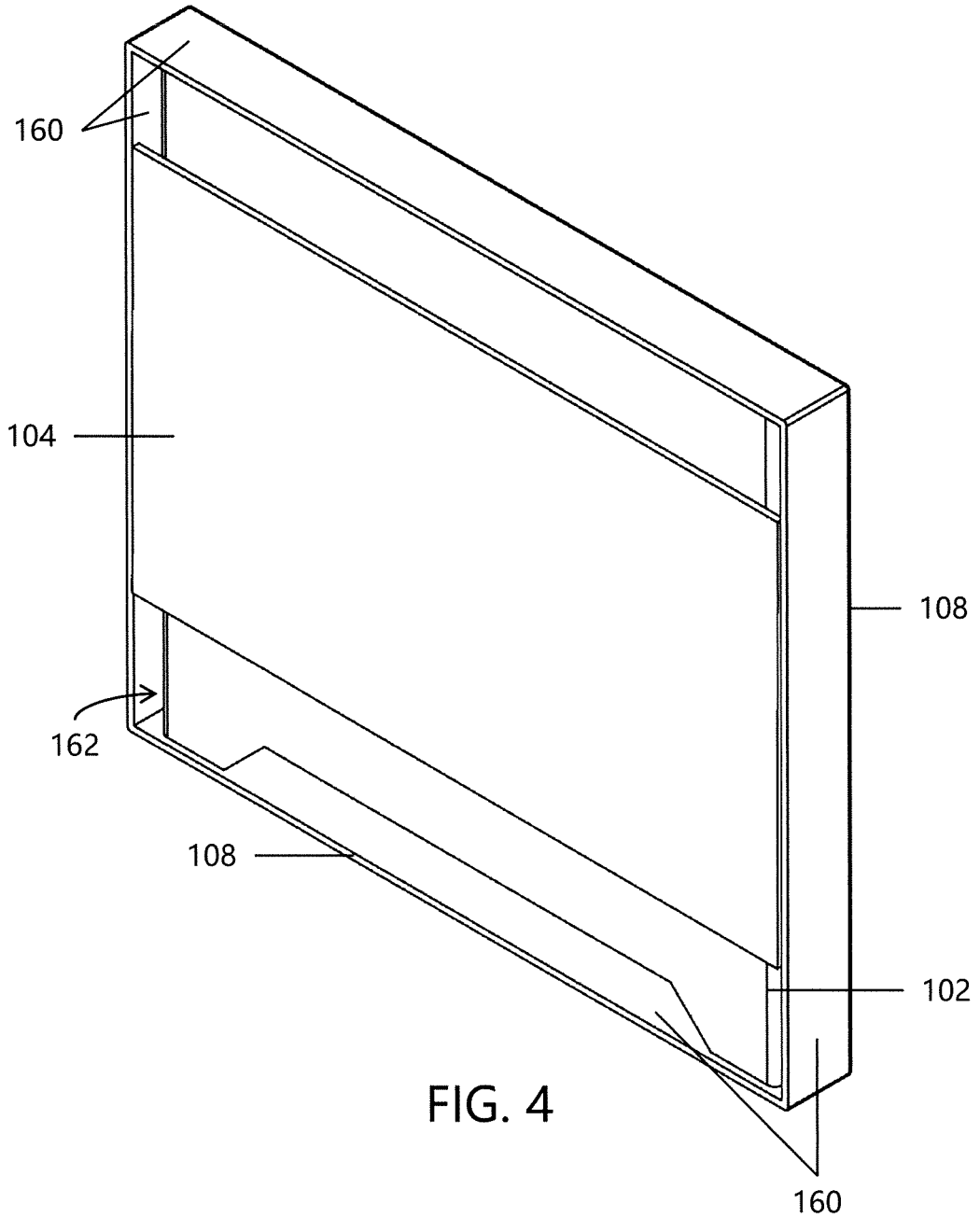
FIG. 4 is a perspective view of the folding table of FIG. 1 which illustrates the table in a bundled configuration in accordance with the present disclosure.
Figure 5:
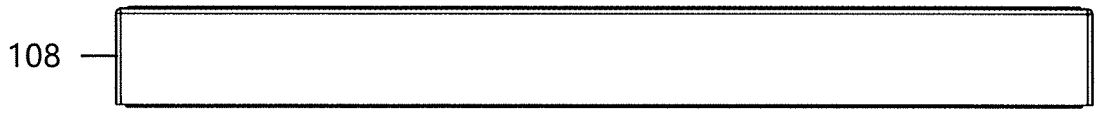
FIG. 5 is an elevation view of the folding table of FIG. 4.
Figure 6:
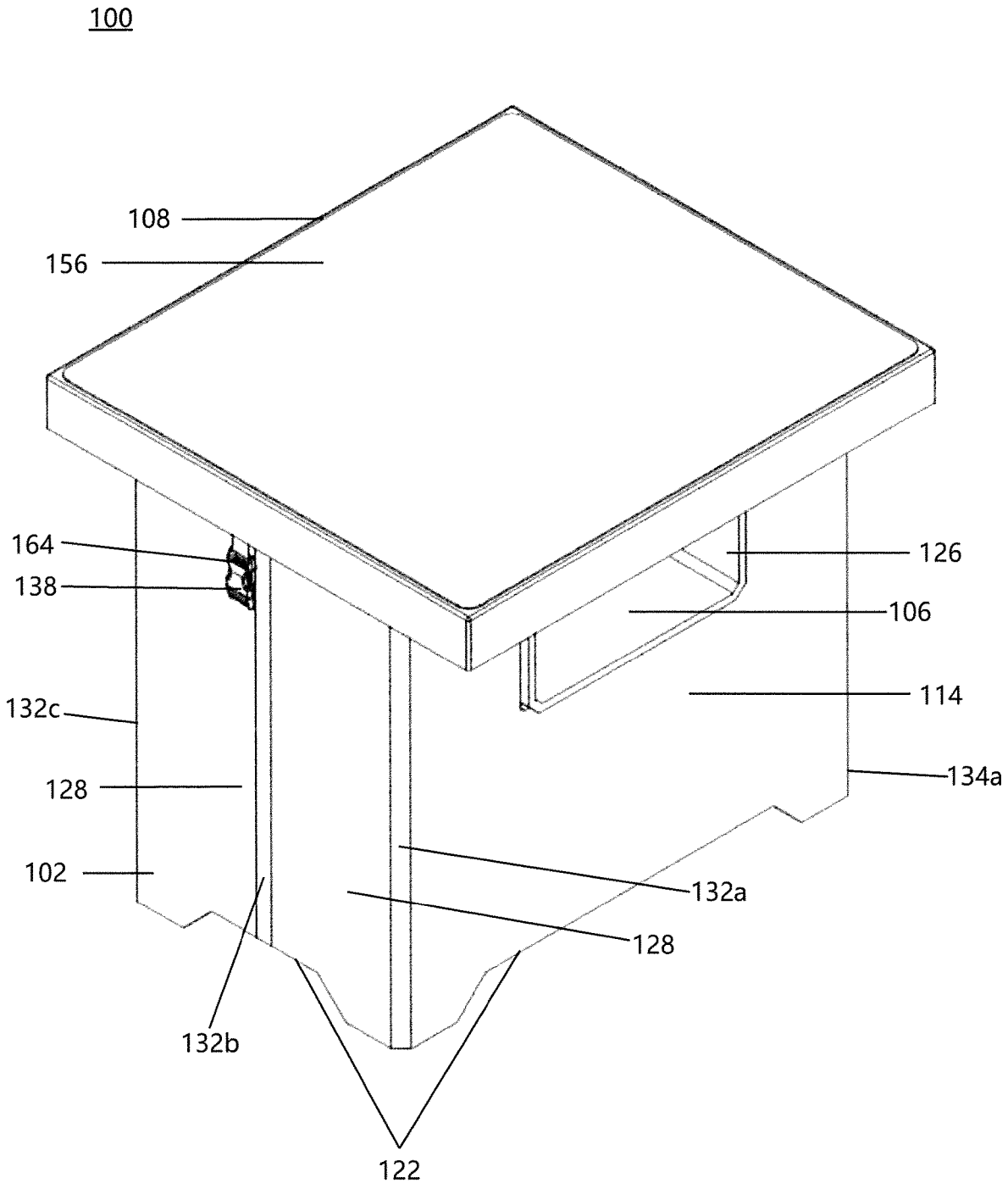
FIG. 6 is an illustration according to another non-limiting embodiment of the present disclosure which illustrates a perspective view of a folding table or work surface in an assembled configuration.
Figure 7:
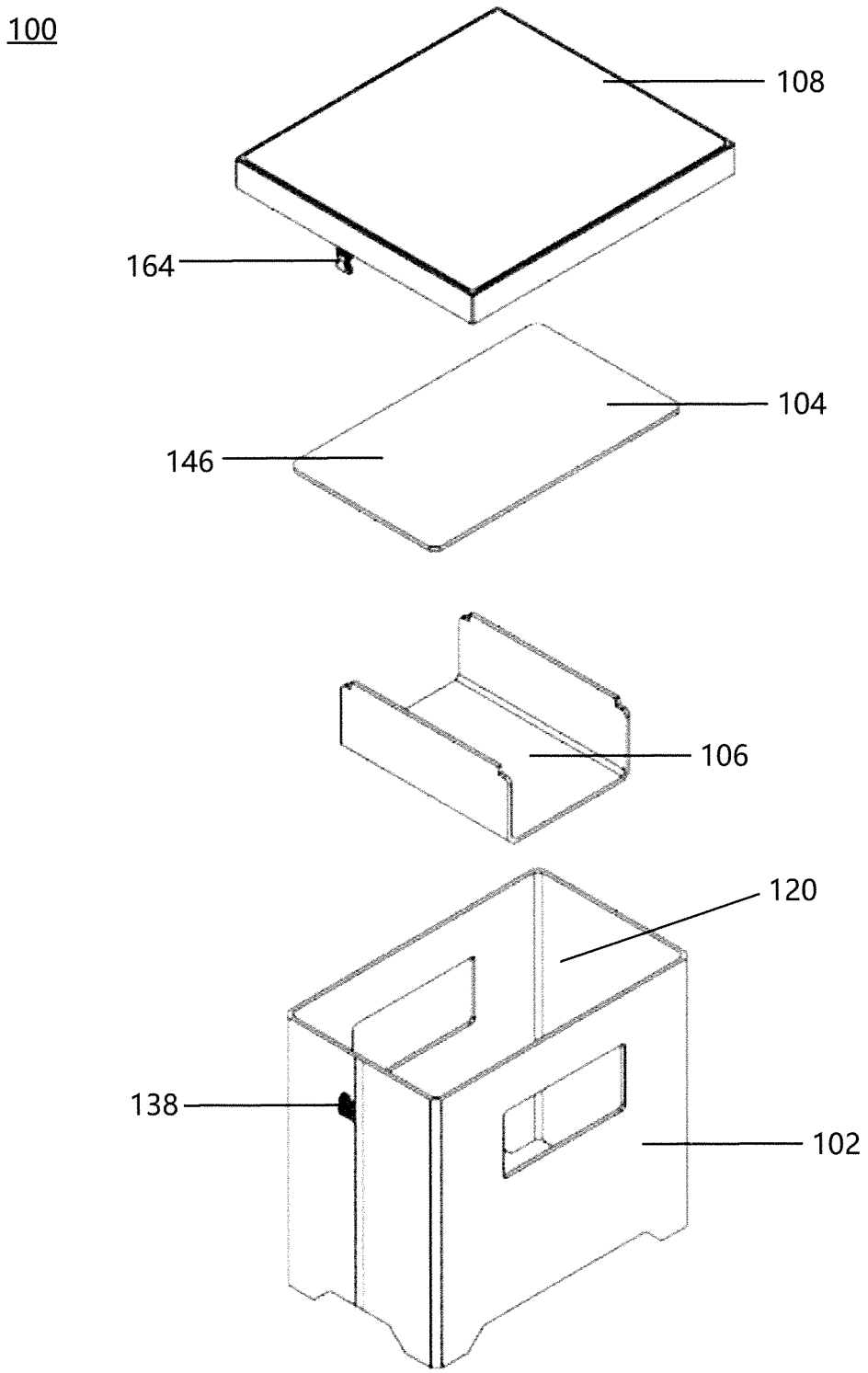
FIG. 7 is top elevation exploded view of the folding table of FIG. 6.
Figure 8:
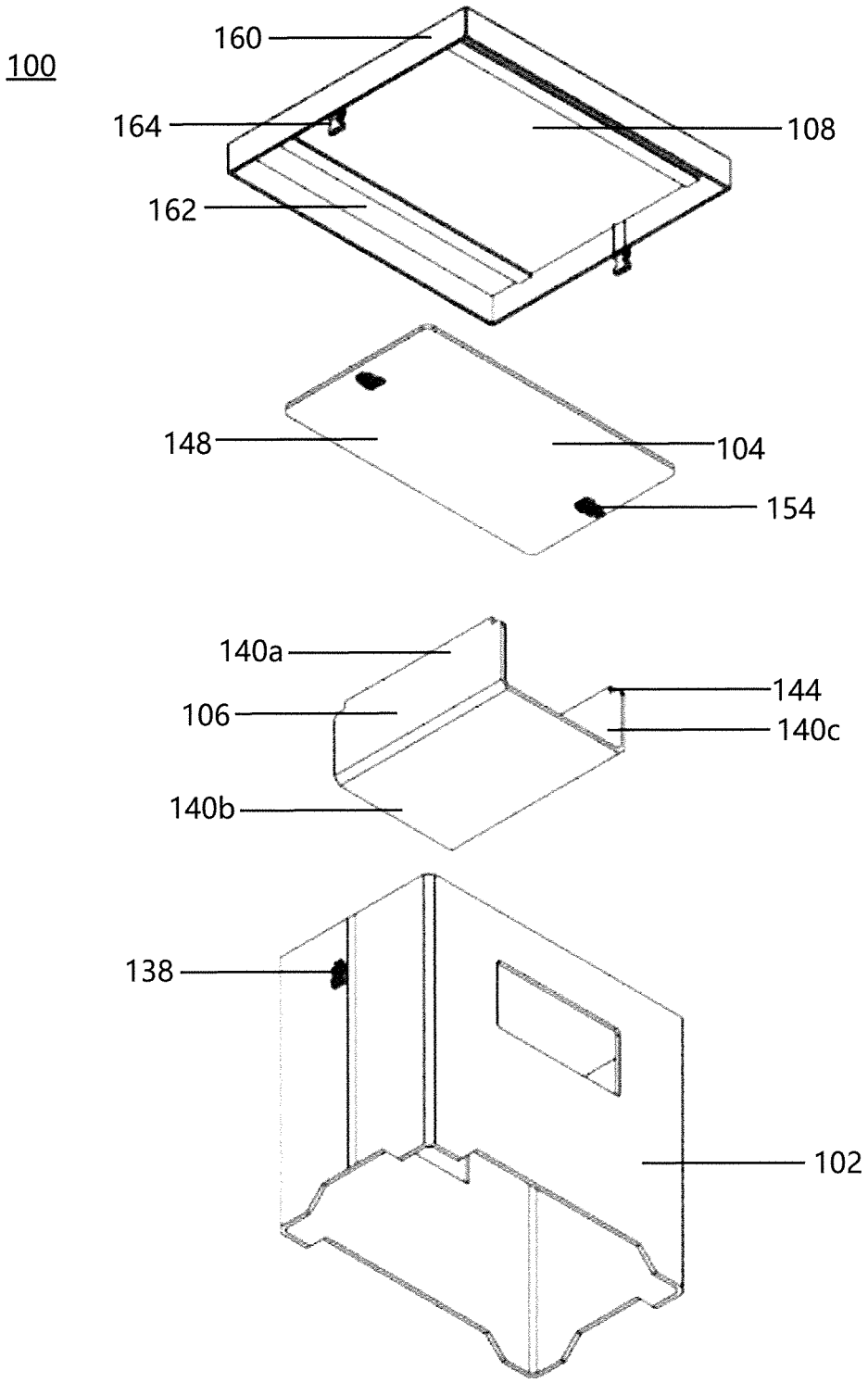
FIG. 8 is bottom elevation exploded view of the folding table of FIG. 6.
Figure 9:
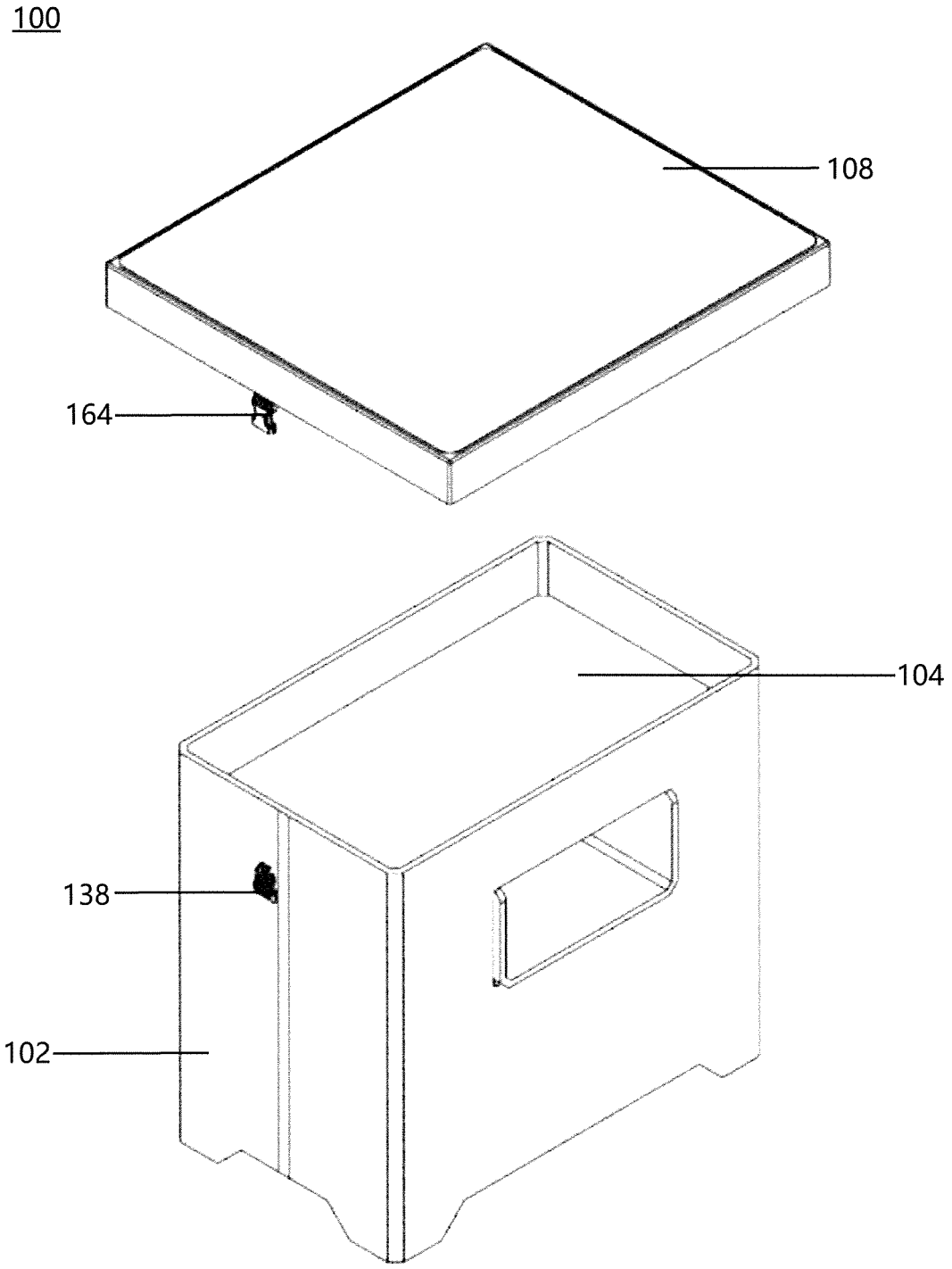
FIG. 9 is front elevation view of a partially assembled folding table of FIG. 6.
Figure 10:
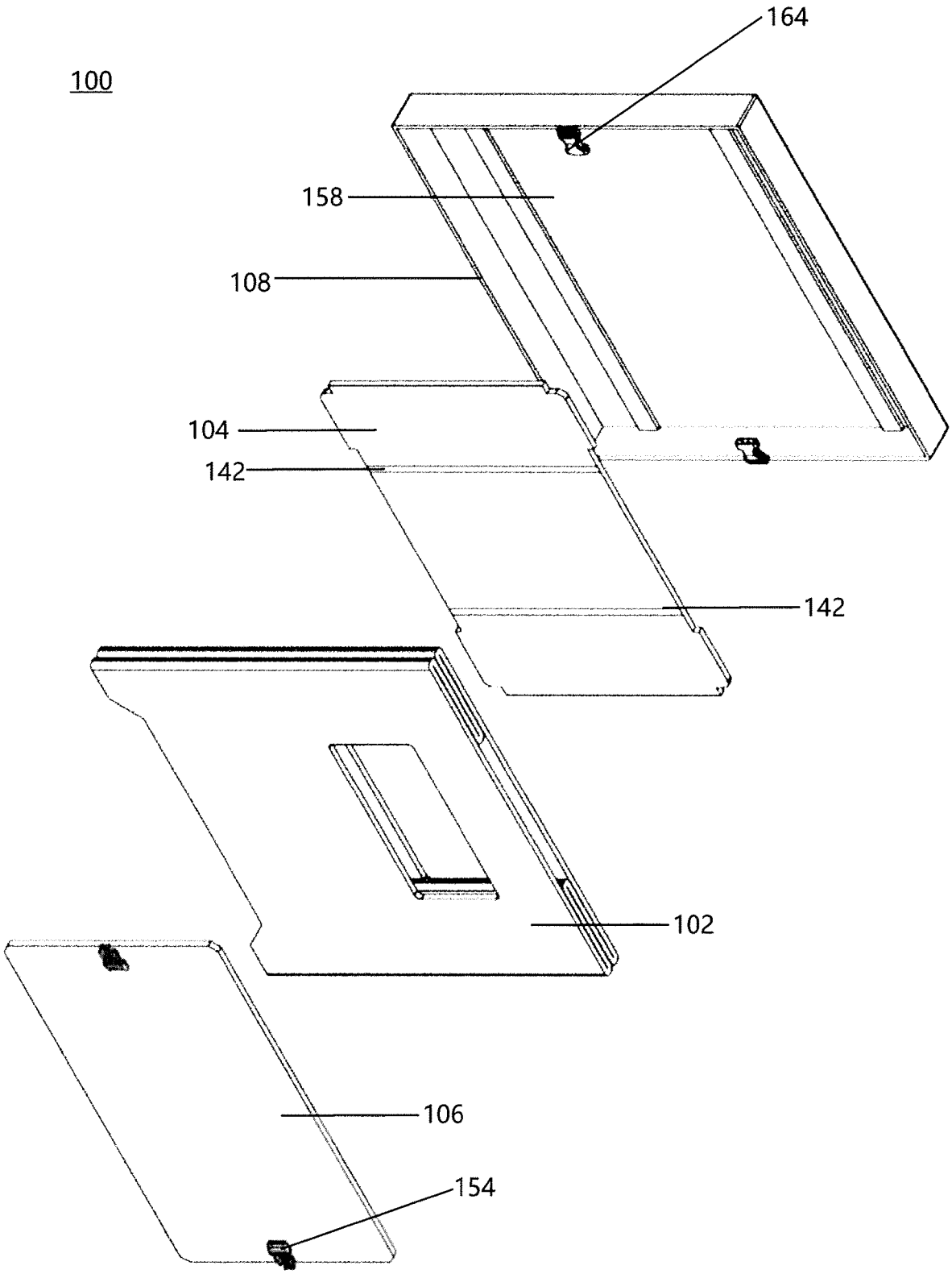
FIG. 10 is bottom elevation exploded view of the folding table of FIG. 6 wherein the components are in the fully folded or fully unfolder configuration after being unpackaged.
Figure 11:
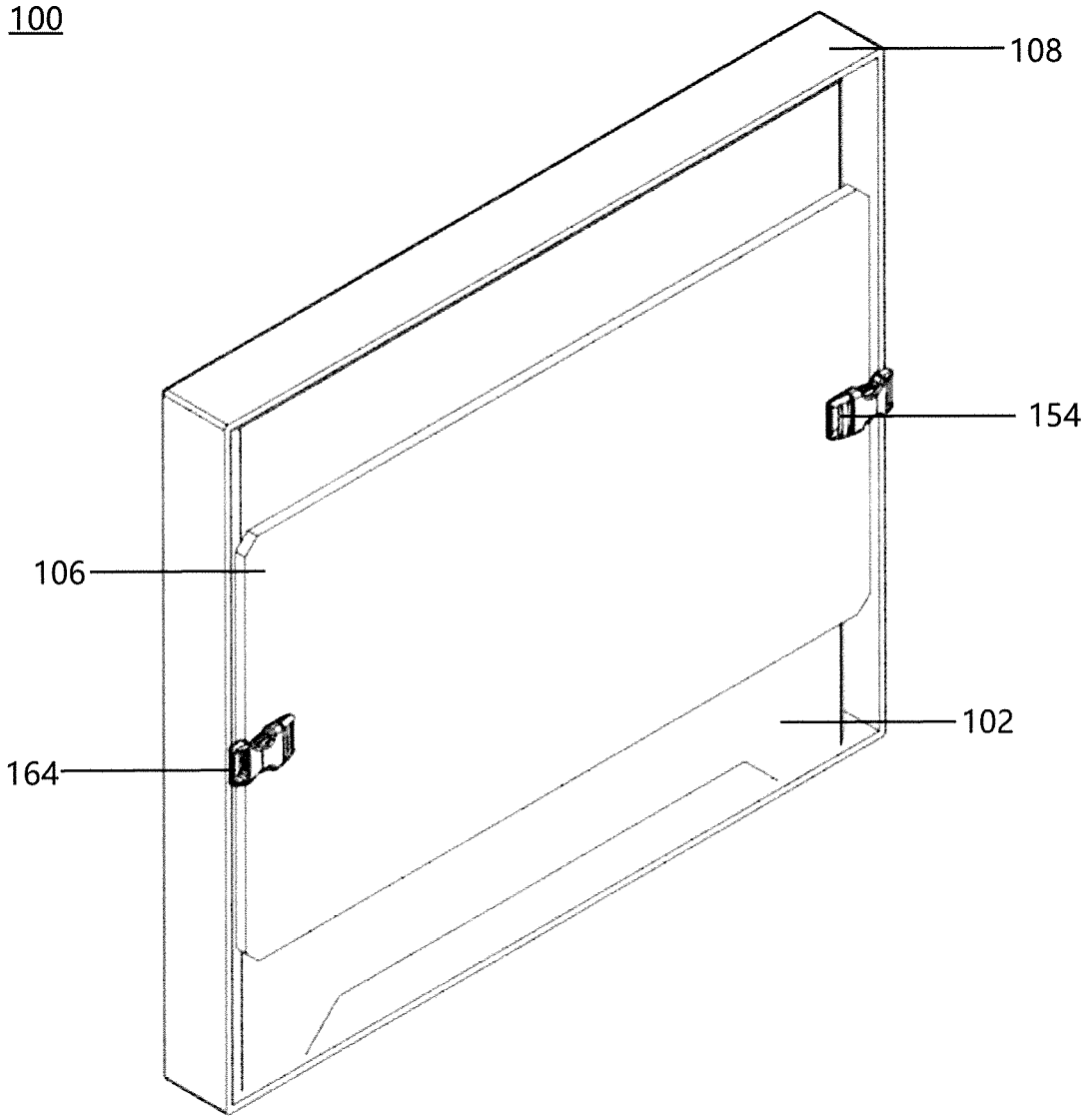
FIG. 11 is a front elevation view of the components of the folding table of FIG. 6 that are fully packaged or bundled.

The primary components of the folding table 100 illustrated in FIGS. 1-11 include a main body portion 102 which supports an upper shelf 104, a lower shelf 106, and a lid 108 which provides the primary work surface of folding table 100. The assembled configuration of folding table 100 is illustrated in FIGS. 1-3 and 6. The bundled configuration of the folding table 100 is illustrated in FIGS. 4-5 and 11. An exploded view of folding table 100 is illustrated in FIGS. 7 and 8. A partially assembled view of folding table 100 is illustrated in FIG. 9.

Generally, folding table 100 is initially provided in the bundled configuration as illustrated in FIGS. 4, 5 and 11. Such configuration reduces the space of folding table 100 during the sale of the table at a store, and the transport of folding table 100 to a certain location. Such bundled configuration also facilitates in the ease of transport of folding table 100.

As illustrated in FIG. 11, the bundled configuration of folding table 100 can be maintained by securement features 154 on upper shelf 104 and securement features 164 on lid 108. As can be appreciated, the bundled configuration of folding table 100 can be maintained by other types of securement arrangement (e.g., straps, hook and loop fasteners, snaps, releasable adhesive, etc.).

During assembly from the bundled configuration to the assembled configuration, or during disassembly from the assembled configuration to the bundled configuration, folding table 100 is in a pre-assembly or partly assembled configuration.

The main body portion 102 of folding table 100 includes a front wall 112, an opposing back wall 114, and one or more collapsible sidewalls 128, 130, all of which generally extend between a top portion 116 and a lower portion 118 of the body. An open interior region 120 is defined by the front wall, back wall, and sidewalls. One or more cut-outs 122 are optionally located generally adjacent lower portion 118 and defines table legs on each the front wall, back wall, and sidewalls of folding table 100. However, such an arrangement is non-limiting since cut-outs may be provided on only some walls or none of the walls without departing from the scope of the present disclosure. The length of the table legs (when used) are generally 0.25-4 inches (and all values and ranges therebetween), and typically 0.5-2.5 inches. The front wall 112 and back wall 114 each further include a respective opening 124, 126 sized to receive and support end portions of the lower shelf 106. As illustrated in FIGS. 1 and 6-9, main body portion 102 has a body length that is greater than a body width; however, this is not required.

The collapsible sidewalls 128, 130 can optionally include one or more fold lines, serrations and/or grooves to facilitate in the folding of the sidewall. For example, first collapsible sidewall 128 includes a first end fold line 132*a*, a central fold line 132*b*, and a second end fold line 132*c*. Similarly, second collapsible sidewall 130 also includes a first end fold line 134*a*, a central fold line 134*b*, and a second end fold line 134*c*. The fold lines are generally made by forming a reduced thickness or reduced stiffness portion along each fold line and on at least one side thereof. For example, a corrugating or debossing process can be applied to the exterior side of fold lines 132*a*-132*c* and 134*a*-134*c* to reduce the stiffness or thickness thereof. As a result, first and second sidewalls 128, 130 can collapse inward toward interior portion 120 for the bundled configuration or fold outward away from the interior portion for the assembled configuration. However, such a configuration is non-limiting. As can be appreciated, front wall 112 and back wall 114 can also or alternatively include one or more fold lines, serrations, and/or grooves to facilitate in the folding of front wall 112 and back wall 1141; however, this is not required.

The collapsible sidewalls 128, 130 can optionally include one or more securement features 136, 138. The securement features 136 (when used) are generally disposed on exterior surface of sidewalls 128, 130; however, it can be appreciated that the securement features can alternatively be disposed on the interior surface of the sidewalls or on both the interior and exterior surfaces of the sidewalls. In some embodiments, securement features 136, 138 can be comprised of one end of a clip buckle commonly known in the art. However, such a configuration is non-limiting. Other non-limiting securement features can include, but are not limited to, hook and loop fastener, snap, latch, strap and strap buckle or clip, and any other releasable connection arrangement.

As discussed in further detail below, securement features 136 are generally configured to engage with corresponding securement features disposed on lid 108 when folding table 100 is in the assembled configuration. As can be appreciated, securement features 138 can also or alternatively be configured to engage with corresponding securement features disposed on upper shelf 104 when folding table 100 is in the assembled configuration; however, this is not required.

The lower shelf component 106 is comprised of one or more segments which are generally configured to allow folding of the lower shelf from a substantially flat arrangement (illustrated in FIG. 10) to a U-shaped arrangement (illustrated in FIGS. 7 and 8). The lower shelf 106 has the substantially flat arrangement when folding table 100 is in the bundled configuration and has the U-shaped arrangement when folding table 100 is in the assembled configuration. As illustrated in FIGS. 2, 7, 8 and 10, lower shelf 106 includes three segments 140*a*, 140*b*, and 140*c*. Segments 140*a* and 140*c* are configured to fold vertically and generally perpendicular to segment 140*b*. Segment 140*b* remains in a horizontal position such that the U-shaped arrangement of lower shelf 106 is created. The folding of segments 140*a* and 140*c* is provided by one or more fold lines 142 which, similar to fold lines 132*a*-132*c* and 134*a*-134*c* discussed above with respect to body 102, are generally made by forming a reduced thickness or reduced stiffness portion along at least one side of each fold line. That is, a corrugating, grooving, or debossing process can be applied to reduce the stiffness or thickness on at least one side of fold lines 142, thereby allowing segments 140*a* and 140*c* of lower shelf 106 to fold into the vertical position. However, such a configuration is non-limiting.

Furthermore, one or more notches 144 are optionally formed in segments 140*a* and 140*c* which allow lower shelf 106 to securely fit within respective openings 124, 126 on front and back walls 112, 114 of body 102. That is, once collapsible sidewalls 128, 130 are folded outward to place body 102 in the assembled configuration, segments 140*a* and 140*c* are folded upward to place lower shelf 106 in its U-shaped arrangement, and notches 144 allow opposing sides of the lower shelf to fit within openings 124, 126 of front and back walls 112, 114 in a secure, stable manner. As best seen in FIG. 3, the notches 144 cause portions of the opposing sides of lower shelf 106 to stick out from front and back walls 112, 114. Generally, lower shelf 106 sticks out about 0-4 inches (and all values and ranges therebetween), typically 0.05-2.5 inches, and more typically 0.05-1 inch. As illustrated in FIGS. 2, 7, and 8-10, openings 124, 126 of front and back walls 112, 114 are typically positioned below the top edge of body 102. Such positioning of openings 124, 126 on front and back walls 112, 114 improves the structural rigidity and strength of body 102 as compared to the openings extending fully to the top edge of body 102. Generally, top of openings 124, 126 is positioned about 0.5-10 inches (and all values and ranges therebetween) below the top edge of body 102, and typically about 1-5 inches below the top edge of body 102. Generally, the maximum width of openings 124, 126 is about 5-90% (and all values and ranges therebetween) the width of collapsible sidewalls 128, 130, typically 10-80% the width of collapsible sidewalls 128, 130, and more typically 30-60% the width of collapsible sidewalls 128, 130. As illustrated in FIGS. 1, 2, 7 and 8-10, openings 124, 126 are generally centrally located between the sides of collapsible sidewalls 128, 130; however, this is not required. Generally the maximum height of openings 124, 126 is about 2-60% (and all values and ranges therebetween) the height of collapsible sidewalls 128, 130, typically 5-50% the height of collapsible sidewalls 128, 130, and more typically 10-45% the height of collapsible sidewalls 128, 130. As illustrated in FIGS. 1, 2, 7 and 8-10, openings 124, 126 are generally located closer to the top edge of collapsible sidewalls 128, 130 than to the bottom edge of collapsible sidewalls 128, 130; however, this is not required.

Once both sides of the lower shelf are placed within openings 124, 126 as described above, lower shelf 106 extends the full length of interior portion 120 between the front and back walls 112, 114. Moreover, notches 144 of lower shelf segments 140*a* and 140*c* abut portions of the interior surface of front and back walls 112, 114 adjacent openings 124, 126. The lower portion of the notched region allows the ends of lower shelf 106 to extend through openings 124, 126. The abutment of notches 144 against the interior surface portions of the front and back walls 112, 114 inhibits or prevents lower shelf 106 from dislodging out from either opening 124 or 126. As a result, in the assembled configuration, lower shelf 106 is securely arranged between front and back walls 112, 114 and can be used to store various items thereon. The lower shelf 106 also provides rigidity and strength to the body 102 once lower shelf 106 is inserted in body 102.

The upper shelf 104 is substantially flat and remains substantially flat whether in the bundled configuration or the assembled configuration (i.e., upper shelf 104 generally does not expand/collapse like sidewalls 128, 130 or fold like lower shelf 106). The upper shelf 104 includes top surface 146, bottom surface 148, and an optional securement apparatus 154 attached on the bottom surface. The upper shelf 104, when in the assembled configuration, has the bottom surface 148 of the upper shelf 104 generally resting on top of the vertical segment portions 140*a* and 140*c* of the lower shelf 106. As such, lower shelf 106 provides structural support for the upper shelf 104, along with any items stored thereon, when folding table 100 is in the assembled configuration. Moreover, as discussed in further detail below, additional structural support is provided by securement apparatus 150, 152. The top surface of upper shelf 104 provides another surface of storing items in folding table 100. As such, when lid 108 is placed on folding table 100, a protective cavity is formed between folding table 100 and the top surface of upper shelf 104.

The securement apparatus 154 of upper shelf 104 can be comprised of one end of a clip buckle commonly known in the art. However, such a configuration is non-limiting. Other non-limiting securement features can include, but are not limited to, hook and loop fastener, snap, latch, strap and strap buckle or clip, and any other releasable connection arrangement.

The sidewalls 128, 130 of body 102 can optionally include interior securement features (not shown) that are configured to engage with corresponding securement features 154 of upper shelf 104; however, this is not required. Such an arrangement can be optionally used to stabilize upper shelf 104 on top of vertical segment portions 140*a*, 140*c* and inhibit or prevent the upper shelf 104 from dislodging off lower shelf 106.

The lid 108 of folding table 100 includes a top surface 156 and a bottom surface 158. The top surface 156 of lid 108 can also be described as the primary work surface provided by folding table 100. The top surface 156 can optionally include a protective layer 157. Such a protective layer 157 (when used) can be a plastic layer, a wood layer, a fiberboard layer, a fabric layer, a composite layer, etc., that can be used to provide structural strength to the lip, provide scratch and/or puncture resistance to the lip, and/or form a water-repellant or water-resistant surface on lid 108. The protective layer can be adhesively connected to top surface 156 and/or connected to top surface 156 by other means (e.g. snaps, hook and loop fastener, friction fit, etc.). The thickness of protective layer 157 (when used) is generally 0.001-0.25 inches (and all values and ranges therebetween).

The lid 108 has one or more sidewalls 160 which generally extend downward from top surface 156 to form an open interior region 162 which is best seen in FIGS. 4, 8 and 10. The interior region 162 has a depth defined between bottom surface 158 and the bottom edges of the lid's sidewalls 160. Generally, the depth of interior region 162 is about 1-6 inches (and all values and ranges therebetween), and typically 1-4 inches. As illustrated in FIGS. 1 and 6, lid 108 has as generally square top surface; however, this is not required. As also illustrated in FIGS. 1 and 6, when lid 108 is placed on top of body 102, two side edges of lid 108 are spaced a greater distance from the top edge of the body than two other edges of lid 108.

As illustrated and shown in FIGS. 4 and 11, interior region 162 of lid 108 has a depth such that the remaining components of folding table 100 (including body 102, upper shelf 104, and lower shelf 106) fit substantially within the interior region when in their bundled configuration. Moreover, one or more securement features 164 are generally disposed on one or more sidewalls 160 of lid 108. In some embodiments, securement features 164 can be comprised of one end of a clip buckle commonly known in the art. However, such a configuration is non-limiting.

The securement features 164 of lid 108 are configured to engage with securement features 154 of upper shelf 104 to thereby maintain the bundled configuration of folding table 100 as illustrated in FIG. 11. That is, once securement features 154 and 164 are engaged, upper shelf 104 generally holds the remaining components of folding table 100 (including collapsible sidewalls 128, 130 of body 102 and lower shelf 106) within interior region 162 of lid 108. In other words, when in the bundled configuration, upper shelf 108 sandwiches collapsible sidewalls 128, 130 and lower shelf 106 against bottom surface 158 and within interior region 162 defined by one or more sidewalls 160 of lid 108. The engagement between securement features 154 and 164 locks upper shelf 104 to lid 108, thereby preventing collapsible sidewalls 128, 130 and lower shelf 106 from dislodging out of interior region 162. Thus, all components of folding table 100 are securely arranged in a space-saving manner when in the bundled configuration. As a result, the bundled configuration facilitates easy storage and transportation of folding table 100.

FIG. 10 illustrates the components of folding table 100 prior to being formed into the bundled configuration or after being separated from lid 108. Body 102 is illustrated in FIG. 11 as being in the fully folded configuration and upper shelf 104 is illustrated as being in the generally flat unfolded configuration. Generally, lid 108 is in a preformed configuration both in the bundled and unbundled configuration; however, this is not required.

In general, the primary components of folding table 100 (i.e., body 102 including sidewalls 128/130, upper shelf 104, and lower shelf 106) can be formed from a single type of material, or from one or more types of material. The folding table 100 may formed from a moderately rigid material and recyclable and disposable material such as, for example, a heavy weight cardboard material, paperboard material, or fiber board material. The folding table 100 can be formed from other or alternative materials, such as, for example, a flexible material, a semi-rigid material, a medium weight cardboard, fiberboard, a rigid plastic, a flexible plastic, or composite materials. The table material may be selected to allow folding, bending, and/or other manipulations of folding table 100 without losing the structural integrity thereof.

The table material may be selected to allow folding table 100 to be discarded or recycled at the end of its lifecycle (i.e., after one or more cycles converting from the bundled configuration to the assembled configuration, and vice versa). While the actual lifecycle of folding table 100 is non-limiting, it should be understood that the useable lifecycle is generally dependent on the way the table is used. For example, heavy and frequent use may result in a shorter usable life compared to lighter, less frequent use.

It will thus be seen that the objects set forth above, among those made apparent from the preceding description, are efficiently attained, and since certain changes may be made in the constructions set forth without departing from the spirit and scope of the disclosure, it is intended that all matter contained in the above description and shown in the accompanying drawings shall be interpreted as illustrative and not in a limiting sense. The disclosure has been described with reference to preferred and alternate embodiments. Modifications and alterations will become apparent to those skilled in the art upon reading and understanding the detailed discussion of the disclosure provided herein. This disclosure is intended to include all such modifications and alterations insofar as they come within the scope of the present disclosure. It is also to be understood that the following claims are intended to cover all of the generic and specific features of the disclosure herein described and all statements of the scope of the disclosure, which, as a matter of language, might be said to fall there between. The disclosure has been described with reference to the preferred embodiments. These and other modifications of the preferred embodiments as well as other embodiments of the disclosure will be obvious from the disclosure herein, whereby the foregoing descriptive matter is to be interpreted merely as illustrative of the disclosure and not as a limitation. It is intended to include all such modifications and alterations insofar as they come within the scope of the appended claims.

What is claimed:

1. A foldable table that comprises a main body portion, an upper shelf, a lower shelf, and a lid, said main body portion including foldable sidewalls to enable said main body portion to be configured between a collapsed position and non-collapsed position, said lower shelf releasably supported on said main body portion when said foldable table is fully assembled and said main body portion is in said non-collapsed position, said upper shelf removably positioned above a bottom surface of said lower shelf when said foldable table is fully assembled and said main body portion is in said non-collapsed position, said lid including lid sidewalls that extend downwardly from a top surface of said lid, said lid sidewalls forming a bottom cavity, a top surface of said bottom cavity of said lid positioned on upper edges of said main body portion when said foldable table is fully assembled such that said upper edges extend into said bottom cavity, said lid providing a primary work surface of said folding table when said foldable table is fully assembled.

2. The foldable table as defined in claim 1, wherein said main body portion includes a body securement feature and said lid includes a lid securement feature, said body securement feature and said lid securement feature configured to releasably connect together to releasably secure said lid to said main body portion when said foldable table is fully assembled and said main body portion is in said non-collapsed position.

3. The foldable table as defined in claim 1, wherein said main body portion includes a front wall, an opposing back wall, two of said foldable sidewalls, and an open interior region defined by said front wall, said back wall, and said foldable sidewalls.

4. The foldable table as defined in claim 3, wherein a bottom portion of said main body portion includes a cut-out portion forming one or more table legs on one or more of said front wall, said back wall, and said foldable sidewalls.

5. The foldable table as defined in claim 3, wherein said each of said foldable sidewalls on said main body portion include one or more fold lines, serrations, and/or grooves facilitating in folding each of said foldable sidewalls.

6. The foldable table as defined in claim 1, wherein said lower shelf includes a plurality of segments configured such that adjacently positioned segments are foldable with respect to one another.

7. The foldable table as defined in claim 1, wherein said lid includes a top surface that has a protective layer, said proactive layer having a thickness of 0.001-0.25 inches.

8. The foldable table as defined in claim 1, wherein side edges of said lower shelf extending at least partially through side openings in said main body portion when said foldable table is fully assembled and said main body portion is in said non-collapsed position.

9. A foldable table that comprises a main body portion, an upper shelf, a lower shelf, and a lid, said main body portion including foldable sidewalls to enable said main body portion to be configured between a collapsed position and non-collapsed position, said lower shelf releasably supported on said main body portion when said foldable table is fully assembled and said main body portion is in said non-collapsed position, said upper shelf removably positioned above a bottom surface of said lower shelf when said foldable table is fully assembled and said main body portion is in said non-collapsed position, said lid positioned on upper edges of said main body portion when said foldable table is fully assembled, said lid providing a primary work surface of said folding table when said foldable table is fully assembled, said lid includes a lid securement feature and said upper shelf includes a shelf securement feature, said lid securement feature and said shelf securement feature configured to releasably connect together to releasably secure said lid to said upper shelf when said main body portion, said upper shelf, and said lower shelf are all positioned in an underside cavity of said lid and said main body portion is in said collapsed position.

10. A foldable table that comprises a main body portion, an upper shelf, a lower shelf, and a lid, said main body portion including foldable sidewalls to enable said main body portion to be configured between a collapsed position and non-collapsed position, said lower shelf releasably supported on said main body portion when said foldable table is fully assembled and said main body portion is in said non-collapsed position, said upper shelf removably positioned above a bottom surface of said lower shelf when said foldable table is fully assembled and said main body portion is in said non-collapsed position, said lid positioned on upper edges of said main body portion when said foldable table is fully assembled, said lid providing a primary work surface of said folding table when said foldable table is fully assembled, said main body portion includes a body securement feature and said lid includes a lid securement feature, said body securement feature and said lid securement feature configured to releasably connect together to releasably secure said lid to said main body portion when said foldable table is fully assembled and said main body portion is in said non-collapsed position, said upper shelf includes a shelf securement feature, said lid securement feature and said shelf securement feature configured to releasably connect together to releasably secure said lid to said upper shelf when said main body portion, said upper shelf, and said lower shelf are all positioned in an underside cavity of said lid and said main body portion is in said collapsed position.

11. The foldable table as defined in claim 10, wherein said main body portion includes a front wall, an opposing back wall, two of said foldable sidewalls, and an open interior region defined by said front wall, said back wall, and said foldable sidewalls.

12. The foldable table as defined in claim 11, wherein a bottom portion of said main body portion includes a cut-out portion forming one or more table legs on one or more of said front wall, said back wall, and said foldable sidewalls.

13. The foldable table as defined in claim 12, wherein said each of said foldable sidewalls on said main body portion include one or more fold lines, serrations, and/or grooves facilitating in folding each of said foldable sidewalls.

14. The foldable table as defined in claim 13, wherein said lower shelf includes a plurality of segments configured such that adjacently positioned segments are foldable with respect to one another.

15. The foldable table as defined in claim 14, wherein said lower shelf includes notches configured to enable said lower shelf to fit within an opening on said front and back walls of said main body portion.

16. The foldable table as defined in claim 15, wherein said lid includes a top surface that has a protective layer, said protective layer having a thickness of 0.001-0.25 inches.

17. A foldable table that comprises a main body portion, an upper shelf, a lower shelf, and a lid, said main body portion including foldable sidewalls to enable said main body portion to be configured between a collapsed position and non-collapsed position, said lower shelf releasably supported on said main body portion when said foldable table is fully assembled and said main body portion is in said non-collapsed position, said upper shelf removably positioned above a bottom surface of said lower shelf when said foldable table is fully assembled and said main body portion is in said non-collapsed position, said lid positioned on upper edges of said main body portion when said foldable table is fully assembled, said lid providing a primary work surface of said folding table when said foldable table is fully assembled, said lower shelf includes notches configured to enable said lower shelf to fit within an opening on said front and back walls of said main body portion.

* * * * *